US007806261B2

(12) United States Patent
Chang

(10) Patent No.: US 7,806,261 B2
(45) Date of Patent: Oct. 5, 2010

(54) CUSHION CASE FOR MOBILE COMPUTER

(76) Inventor: Cheng-Wen Chang, 2F. No. 7, Hsing-Yi Rd., Peitou District, Taipei City (TW) 11284

( * ) Notice: Subject to any disclaimer, the term of this patent is extended or adjusted under 35 U.S.C. 154(b) by 0 days.

(21) Appl. No.: 12/397,305

(22) Filed: Mar. 3, 2009

(65) Prior Publication Data

US 2009/0230007 A1 Sep. 17, 2009

(30) Foreign Application Priority Data

Mar. 17, 2008 (TW) ..... 97204534 U

(51) Int. Cl.
*B65D 85/00* (2006.01)

(52) U.S. Cl. ..... 206/320; 206/523

(58) Field of Classification Search ..... 206/586, 206/320, 522, 594, 592, 523; 190/107, 127, 190/902, 903, 125
See application file for complete search history.

(56) References Cited

U.S. PATENT DOCUMENTS 4,472,870 A * 9/1984 Kotkins, Jr. ..... 29/445
5,494,157 A * 2/1996 Golenz et al. ..... 206/320
5,624,035 A * 4/1997 Kim ..... 206/522
5,775,497 A * 7/1998 Krulik ..... 206/320
5,904,230 A * 5/1999 Peterson ..... 190/107
6,059,079 A * 5/2000 Krulik ..... 190/112
6,223,870 B1 * 5/2001 Godshaw ..... 190/107
6,334,533 B1 * 1/2002 Hollingsworth et al. ..... 206/320
6,375,009 B1 * 4/2002 Lee ..... 206/522
6,547,070 B1 * 4/2003 Kolpin ..... 206/317
7,293,649 B2 * 11/2007 Gelphman et al. ..... 206/320
7,448,495 B2 * 11/2008 Sadow ..... 206/522
2002/0125092 A1 * 9/2002 Nykoluk et al. ..... 190/127
2003/0221924 A1 * 12/2003 Tong ..... 190/107
2005/0016808 A1 * 1/2005 Sapyta ..... 190/107

* cited by examiner

*Primary Examiner*—David T Fidei

(57) ABSTRACT

A cushion case for mobile computer is provided. The cushion case for mobile computer comprises a perimeter belt padding and a panel padding. The perimeter belt padding has two lateral side padding portions, a bottom padding portion, and a lid padding portion. The panel padding has a top panel padding portion and a base panel padding portion. The perimeter belt padding is sewn onto the panel padding, and the two lateral side padding portions form two lateral side walls of the cushion case, the bottom padding portion forms the bottom side wall of the cushion case, the lid padding portion forms the lid of the cushion case and is capable of being opened and closed, the top panel padding portion forms the top panel wall of the cushion case, and the base panel padding portion forms the base panel wall of the cushion case.

10 Claims, 9 Drawing Sheets

CUSHION CASE FOR MOBILE COMPUTER

BACKGROUND OF THE INVENTION

1. Field of the Invention

The present invention relates to a container. In particular, the present invention relates to a padded cushion case having means for loading and protecting a mobile computer against damage from impact or shock. Protection performance can be measured by drop tests.

2. Description of the Related Art

Mobile computers such as laptops, notebook computers or netbook computers have become increasingly popular due to their mobility, allowing the use of computers on the go. But mobile computers are vulnerable to damage if dropped, bumped, compressed against other objects or otherwise impacted which often occurs during traveling or transporting.

Conventional solutions to this problem generally involve in providing a flat layer of padded storage compartment to hold the mobile computer within a carrying case or adapting tube-shaped padding disposed at interior side walls of a carrying case. However, in practice, such designs have done very little to prevent the damage caused by impacts of drops. And few have passed the drop tests which require the drop execution on every edge, corner, side and face of a case with a mobile computer loaded inside.

SUMMARY OF THE INVENTION

The objective of the cushion case is to provide fitted loading and effective protection for a mobile computer. By absorbing and retarding the impact, the cushion case can protect or reduce the damage from dropping, bumping or compression damage of the mobile computer. Such protection performance can be evaluated by acceleration G values measured by drop tests.

The cushion case comprises six padding portions, padding portions can vary in size according to the size of a mobile computer. Each cushion case holds one mobile computer. There is a movable lid padding portion to open or close the opening portion of a cushion case to access and remove the mobile computer. A padding portion is composed of a cushion foam and a coat, wherein the cushion foam is inserted or enclosed inside the coat. The cushion foam provides impact absorbing function. The coat can be made of fabric or leather. Since there are plenty selections of color, pattern regarding fabric and leather, the appearance design will be almost unlimited for the coat. Therefore, as is for the appearance of cushion case.

The present invention can be carried by hand, placed inside other bag or pack or luggage for traveling, placed inside a shipping carton or transit case for transportation. It can be adopted as a functional component by manufacturers of bag/pack/luggage which can be detachable or to be fixed within a bag/pack/luggage to serve as a protection component.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

FIG. 8 is the reference drawing for present invention.

Figure 1:
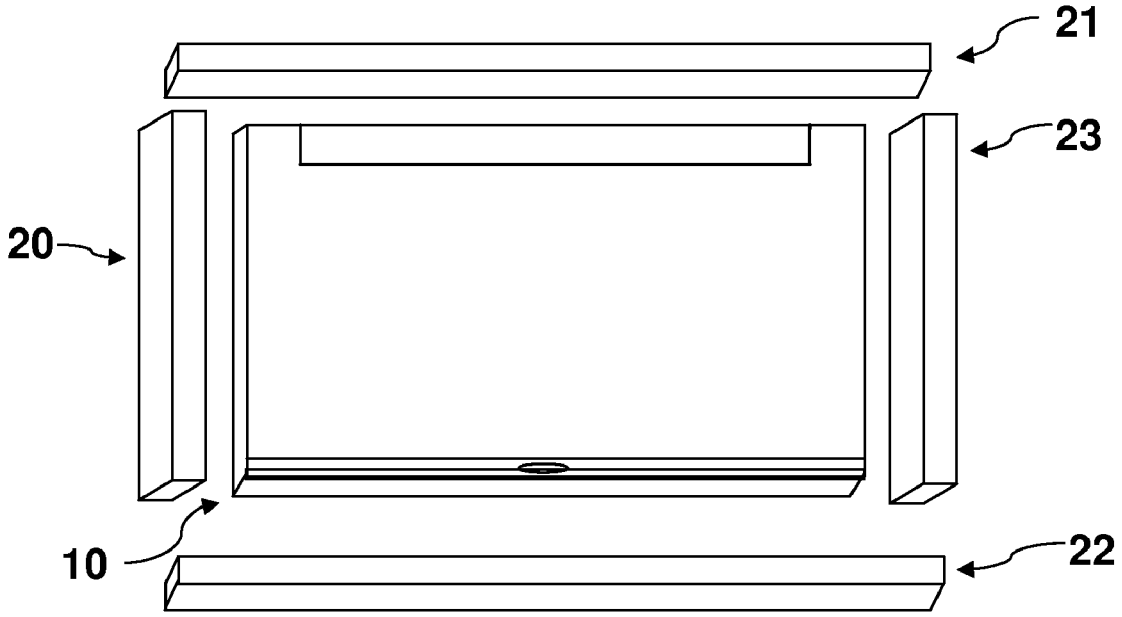
FIG. 1 is a perceptive view shows cushion foams, in rectangular bar shape, respectively situated at each side wall of a mobile computer.

The features and advantages of the present invention will become clearer from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION OF THE PREFERRED EMBODIMENT

Cushion Foam:

Cushion foam is the internal material of the present invention. The cushion foam can be, but not limited to, material of Expanded Polyethylene (EPE), Expanded Polyurethane (PU), Expanded Polypropylene (EPP), Neoprene, EVA and other impact absorbing cushion materials exhibiting like property. These materials are made to contain air cell within them. The air cell can absorb impact energy as retarding and dispersing the impact force. A single type of cushion foam or combining various types of cushion foams can be optionally adopted for present invention. If different cushion foams are used for the same present invention, different protection performance can be measured by the acceleration G value acquired by drop tests.

Fabric or Leather:

Fabric or leather is the exterior material of the present invention. Fabric or leather will be stitched and fabricated to become the coat which is further used to cover and enclose the cushion foam. Since there are plenty of selections by color, pattern regarding fabric and leather, adoption of fabric and leather provides unlimited possibility of appearance design for the coat, and thus, for the present invention, Coat:

Fabric or leather, through the process of mockup, cutting, sewing, stitching, is fabricated as a coat which is further used to cover and enclose cushion foams. Present invention includes a set of perimeter belt coats and a set of panel coats.

Padding Portion:

Padding portions are composed of the coats and the cushion foams. In an embodiment, a padding portion is made when cushion foam is inserted into and enclosed within the coat. In present invention the cushion case comprises six padding portions, and each padding portion is disposed for the respective side walls, top and base of a mobile computer.

Cushion Case:

All six padding portions, by assembly, adhering and supplemental stitching, are fabricated to structure a cushion case in solid rectangular shape. There is a lid padding portion which is movable to perform opening/closing function for the opening portion of cushion case. A mobile computer is accessed and removed through the opening portion of the cushion case.

Procedures of Embodiment

Procedure 1. Measure the dimensions and weight of a mobile computer.

Procedure 2. Design the structure of cushion case according to the required drop test acceleration G value.

Procedure 3. Select suitable type and quality of cushion foam.

Procedure 4. Select preferred fabric or leather.

Procedure 5. Stitch fabric or leather to fabricate a fabric coat or a leather coat.

Procedure 6. Cut cushion foam into the required shape, sizes, and thickness and thereafter, inserted into the respective coats to make a padding portion.

Procedure 7. Assemble the padding portions to construct a cushion case.

FIG. 1 shows the rectangular bar shape cushion foams which will be disposed at the side walls of a mobile computer 10. These cushion foams are, in a sequential alignment, a first lateral side cushion foam 20, a bottom side cushion foam 21, a second lateral side cushion foam 23, and a lid side cushion foam 22.

Figure 2:
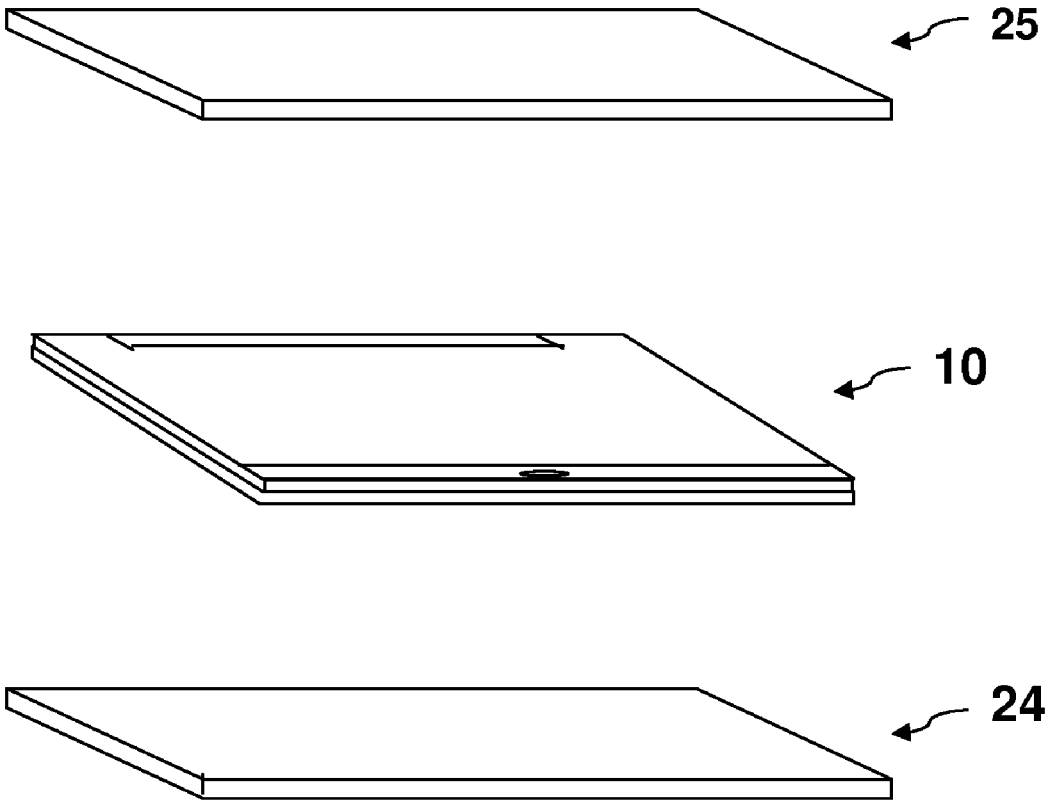
FIG. 2 is a perceptive view shows cushion foams, in flat panel shape, on the top of and under the base of a mobile computer.
Figure 3:
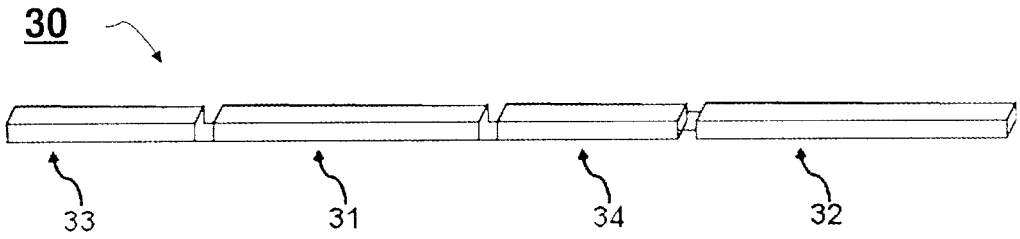
FIG. 3 is a perceptive view shows the perimeter belt coat. The perimeter belt coat will be employed for insertion and enclosure of cushion foams shown in FIG. 1.

FIG. 2 shows the flat panel shape cushion foams which will be disposed at the top and base of a mobile computer 10. The top panel cushion foam 25 is disposed for the top of a mobile computer. The base panel cushion foam 24 is disposed for the base of a mobile computer FIG. 3 illustrates a perimeter belt coat 30. The perimeter belt coat 30 includes a first lateral side coat 33, a bottom side coat 31, a second lateral side coat 34, and a lid side coat 32. The perimeter belt coat is made through process of mockup, cutting, sewing and stitching. The perimeter belt coat 30 will be used for the insertion and enclosure of the cushion foam depicted in FIG. 1.

Figure 4:
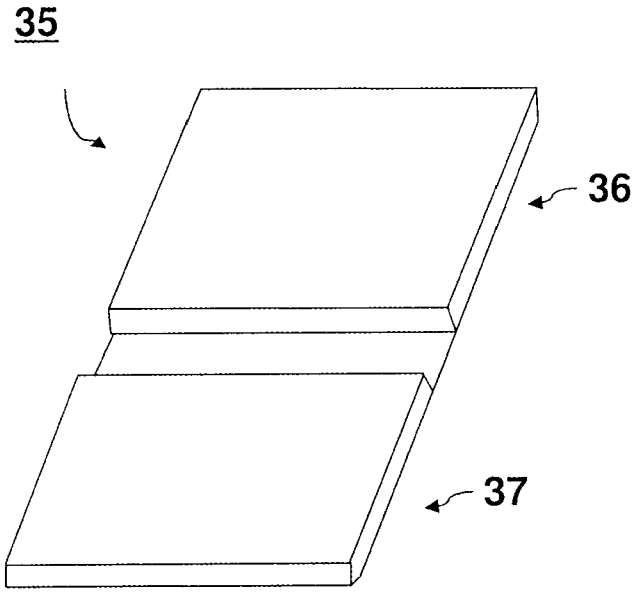
FIG. 4 is a perceptive view shows the panel coat. The panel coat will be employed for insertion and enclosure of cushion foams shown in FIG. 2.

FIG. 4 illustrates a panel coat 35. The panel coat 35 is made through process of mockup, cutting, sewing and stitching. The panel coat 35 comprises a top panel coat 36 and a base panel coat 37, and is used to insert and enclose top panel cushion foam 25 and base panel cushion foam 24, depicted in FIG. 2.

Figure 5:
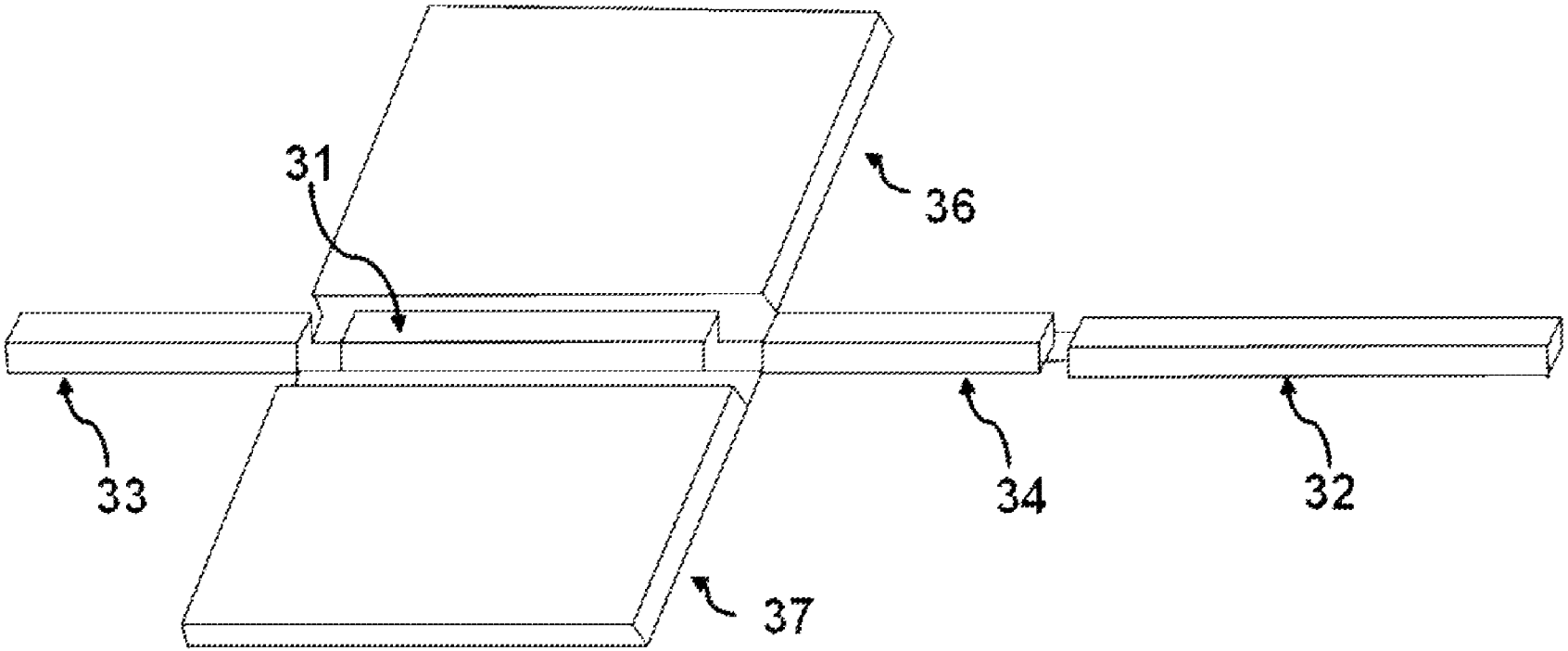
FIG. 5 is a perceptive view shows the perimeter belt coat and the panel coat overlapped and stitched together to become one piece.

Combine the Perimeter Belt Coat 30 With the Panel Coat 35:

FIG. 5 shows a perimeter belt coat 30, depicted in FIG. 3, and a panel coat 35, depicted in FIG. 4, overlapped and stitched together into one piece. The combination rule is: (i) the perimeter belt coat 30 be placed at an upper position, the panel coat 35 be placed at a lower position, and (ii) the bottom side coat 31 of the perimeter belt coat 30 is placed upon the center portion of a panel coat 35.

Figure 6:
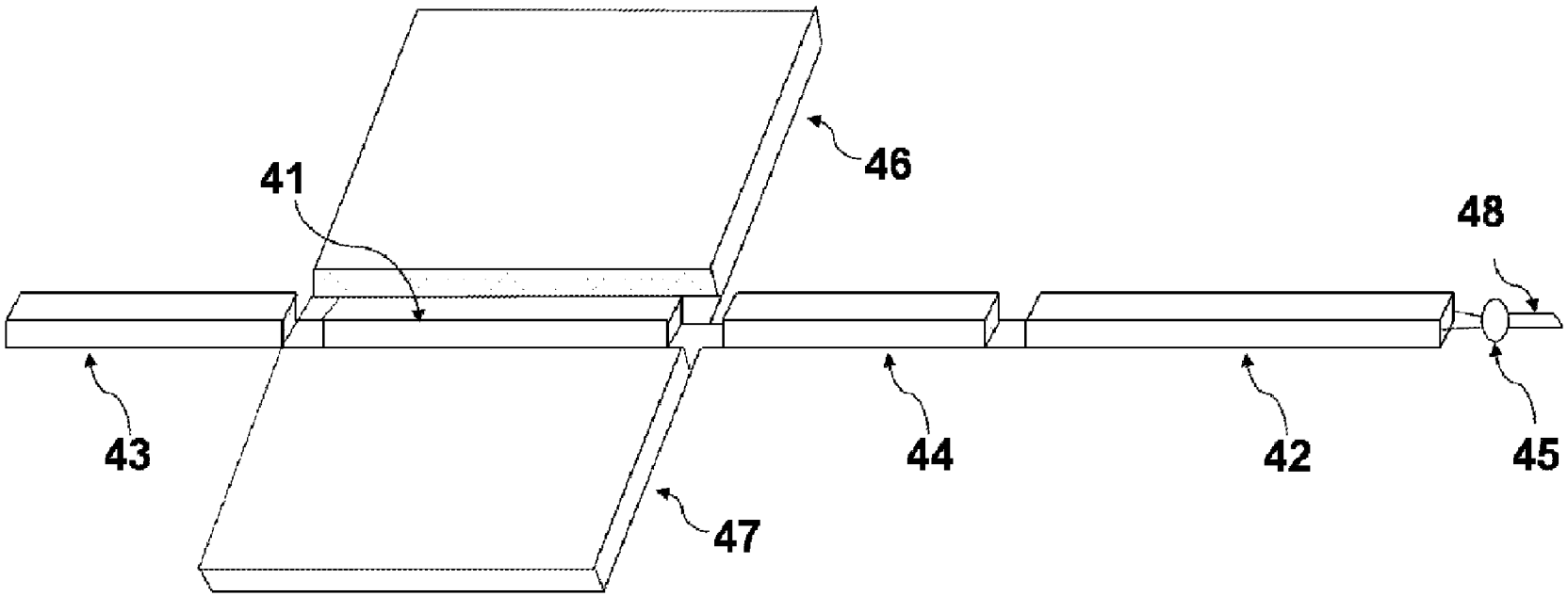
FIG. 6 shows the insertion and enclosure of cushion foams within respective coats to become padding portions. Auxiliary items, a ring and a ring-pull-belt, are additionally attached to one end of the perimeter belt coat.

FIG. 6 shows all padding portions of a cushion case aligned horizontally.

A padding portion is made when a cushion foam is inserted and enclosed within a coat. A cushion case has six padding portions, comprising: (i) a perimeter belt padding surrounding the side walls of a mobile computer 10 including four padding portions: a first lateral side padding portion 43, a bottom padding portion 41, a second lateral side padding portion 44, a lid padding portion 42, and (ii) a panel padding covering the top and the base of a mobile computer 10, including two padding portions: a top panel padding portion 46 and a base panel padding portion 47.

The lid padding portion 42 comprises two detachable auxiliary accessories, a ring 45 and a ring-pull-belt 48. The ring 45, can be a metal or plastic round-shape item for joining articles, is attached in the end portion of the lid side coat 32 when the lid side coat 32 is sealed. The ring-pull-belt 48, can be a piece of fabric or leather, has a small tunnel to be attached to the ring 45. The ring 45, ring-pull-belt 48 and lid padding 42 are joined together to serve open/close function for the present invention. Please refer to FIG. 6.

Structure Padding Portions to Construct a Cushion Case:

Padding portions are assembled, adhered by adhesive or glue or by supplemental stitching, to construct a case in solid status. After the adhesive dry, a cushion case becomes firm and is embodied.

The assembly rule includes: (i) two lateral side padding portions 43, 44 clamp and adhere to a bottom padding portion 41, and (ii) top panel padding portion 46 and base panel padding portion 47 clamp and adhere to two lateral side padding portions 43, 44 with bottom padding portion 41.

Figure 7:
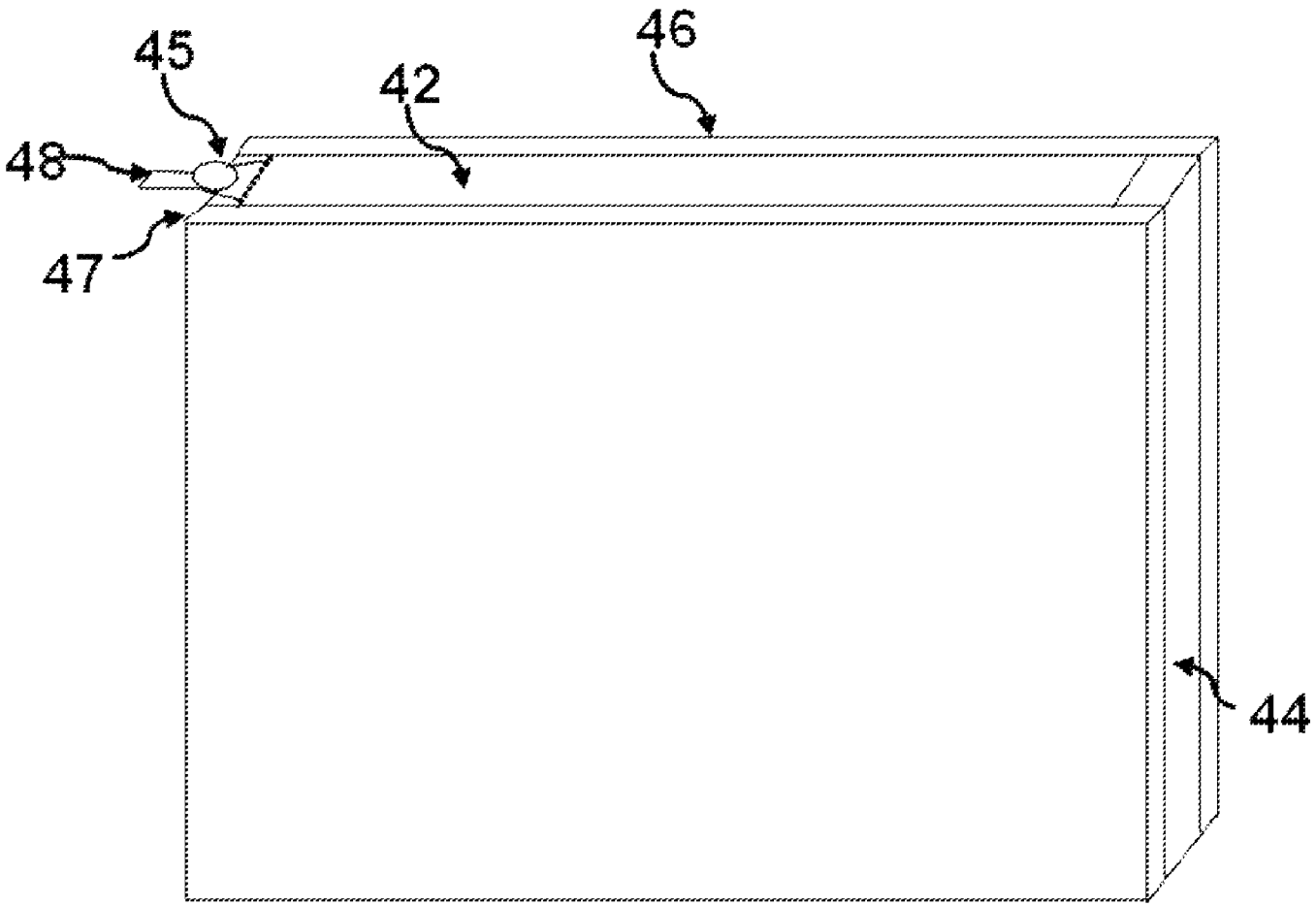
FIG. 7 is a perceptive view shows a completion of the cushion case. Padding portions be structured and fabricated to a cushion case.

FIG. 7 shows a finished cushion case.

Figure 8:
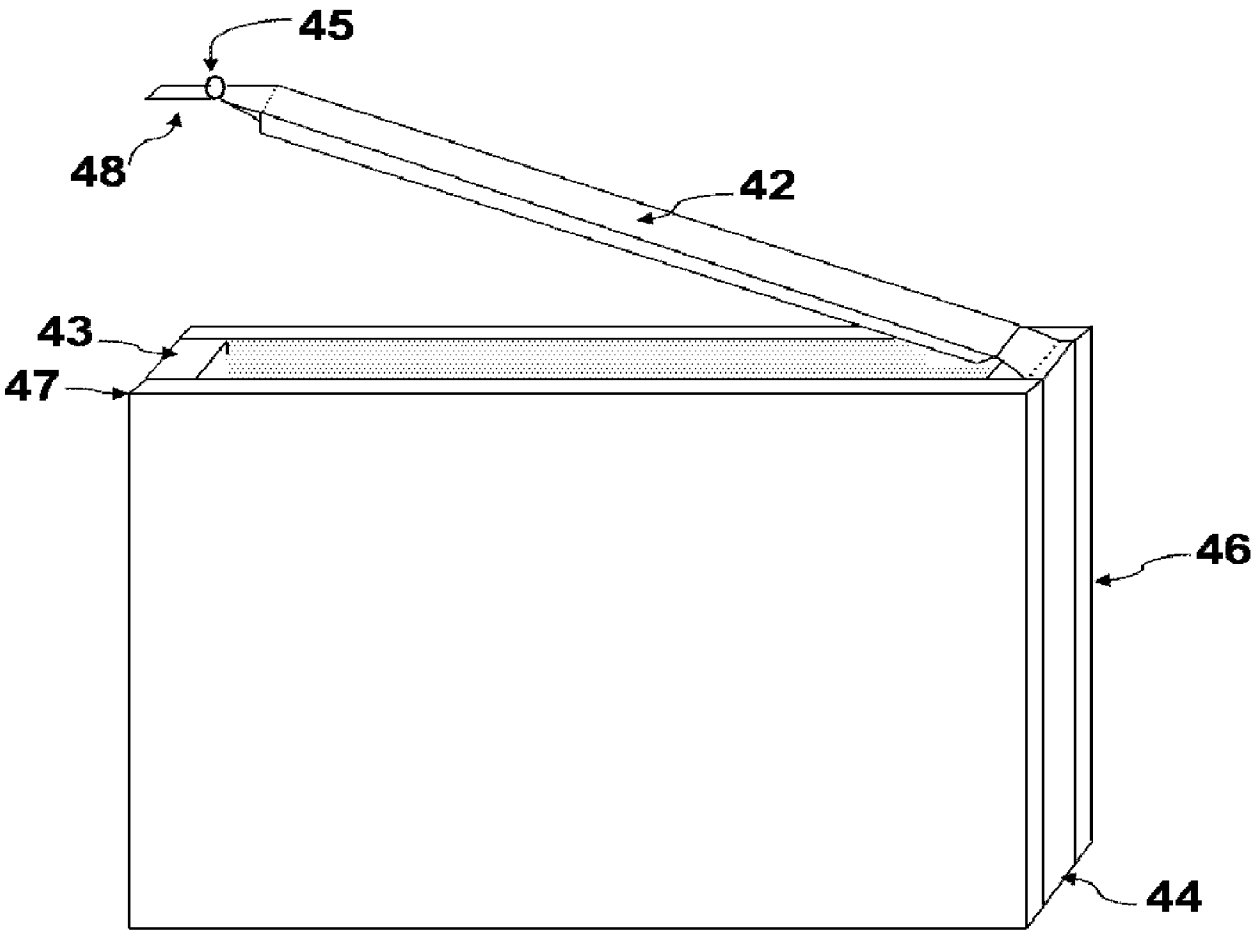
FIG. 8 is a perceptive view shows a cushion case whose lid padding portion is raised to open the cushion case.

FIG. 8 shows an opened cushion case. Cushion case has an opening for the access and removal of a mobile computer 10. Open/close function is served by the lid padding portion 42, the ring 45 and the ring-pull-belt 48, depicted in [0047] and FIG. 6.

Figure 9:
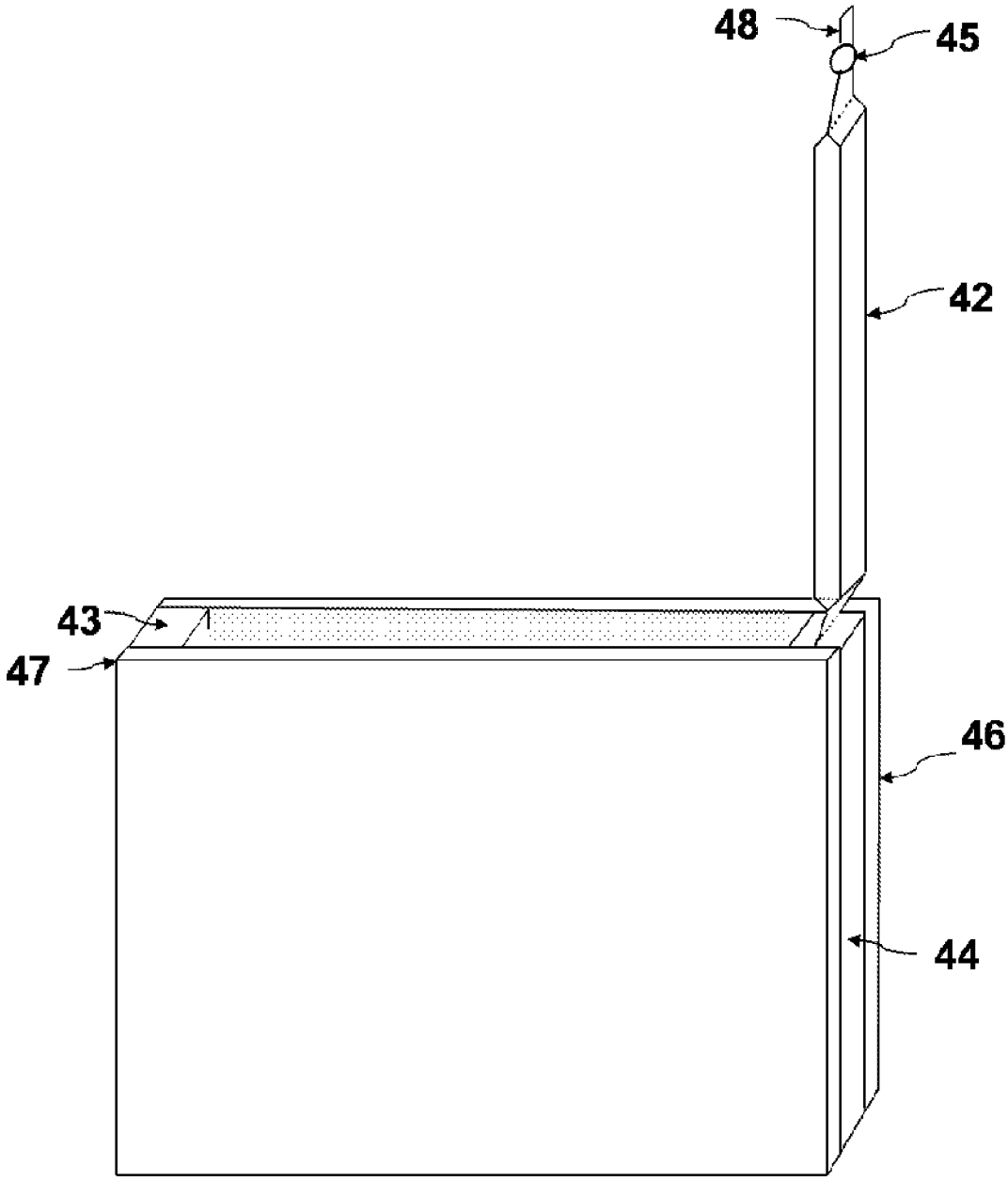
FIG. 9 is another perceptive view shows a cushion case whose lid padding portion is opened.

FIG. 9 shows another opened cushion case. Cushion case has an opening for the access and removal of a mobile computer 10. Open/close function is served by the lid padding portion 42, the ring 45 and the ring-pull-belt 48, depicted in [0047] and FIG. 6.

Figure 10:
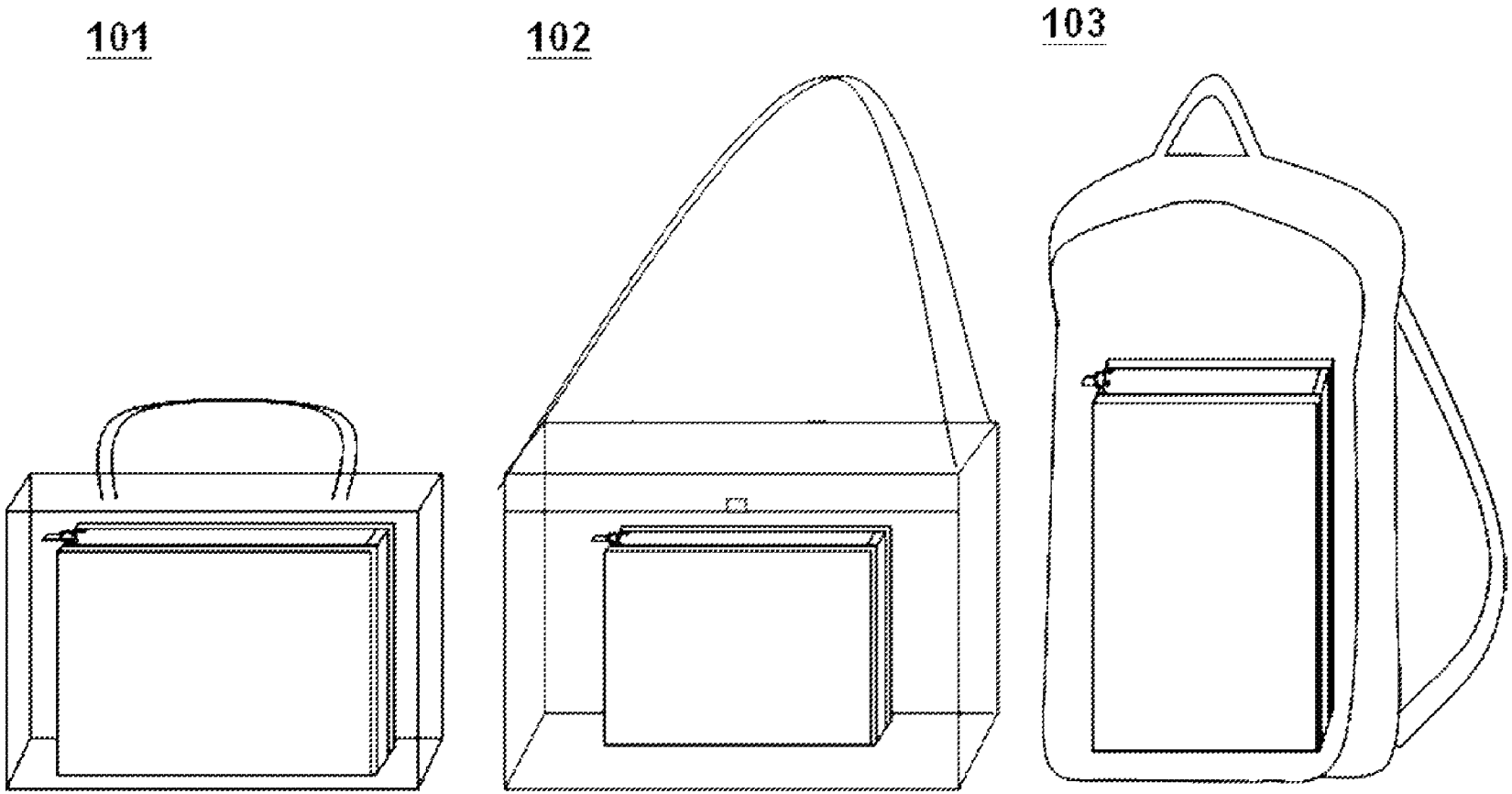
FIG. 10 is a perceptive view shows the cushion case can be placed within a suitcase, a bag, a backpack for illustration of its applications.

FIG. 10 shows several applications of a cushion case. A cushion case is placed within a hand bag 101, a shoulder bag 102, and a backpack 103.

Although the present invention has been explained per its preferred embodiment, it is to be understood that many other possible modifications and variations can be made without departing from the spirit and scope of the invention as hereinafter claimed.

What is claimed is:

1. A cushion case for a mobile computer, comprising:

a perimeter belt padding, having a first and a second lateral side padding portions, a bottom padding portion, and a lid padding portion; and a panel padding, having a top panel padding portion and a base panel padding portion;

wherein the bottom padding portion of the perimeter belt padding is sewn onto the panel padding in between the top panel padding portion and the base panel padding portion to form a bottom side wall, and the rest of the perimeter belt padding is sewn onto the panel padding to form two lateral side walls, and a lid, which is capable of being opened and closed, of the cushion case, wherein the two lateral side padding portions form the two lateral side walls of the cushion case, the bottom padding portion forms the bottom side wall of the cushion case, the lid padding portion forms the lid of the cushion case; wherein the panel padding forms a top panel wall and a base panel wall of the cushion case, wherein the top panel padding portion forms the top panel wall of the cushion case, and the base panel padding portion forms the base panel wall of the cushion case.

2. The cushion case for a mobile computer of claim 1, wherein the two lateral side padding portions, the bottom padding portion, the lid padding portion, the top panel padding portion, and the base panel padding portion are fitted tightly to form a closed space.

3. The cushion case for a mobile computer of claim 1, wherein the perimeter belt padding comprises two lateral side coats, a bottom side coat, and a lid side coat.

4. The cushion case for a mobile computer of claim 3, wherein the perimeter belt padding comprises two lateral side cushion foams, a bottom side cushion foam, and a lid side cushion foam, wherein the two lateral side cushion foams are each inserted into one of the two lateral side coats, the bottom side cushion foam is inserted into the bottom side coat, and the lid side cushion foam is inserted into the lid side coat.

5. The cushion case for a mobile computer of claim 1, wherein the panel padding comprises a top panel coat portion, a base panel coat portion, a top panel cushion foam, and a base panel cushion foam, wherein the top panel cushion foam is inserted into the top panel coat portion and the base panel cushion foam is inserted into the base panel coat portion.

6. The cushion case for a mobile computer of claim 1 further comprising a ring and a ring-pull-belt, wherein the ring is attached to an opening end of the lid padding and the ring-pull-belt is attached to the ring for pulling the lid padding open.

7. A cushion case for a mobile computer, comprising:

a perimeter belt padding, have a first lateral side padding portion formed only with a first lateral side coat and a first lateral side cushion foam, a second lateral side padding portion formed only with a second lateral side coat and a second lateral side cushion foam, a bottom padding portion formed only with a bottom padding coat and a bottom cushion foam, and a lid padding portion formed only with a lid padding coat and a lid cushion foam; and a panel padding, having a top panel padding portion formed only with a top panel padding coat and a top panel padding cushion and a base panel padding portion formed only with a base panel padding coat and a base panel padding cushion;

wherein the perimeter belt padding is sewn onto the panel padding to form two lateral side walls, a bottom side wall, and a lid, which is capable of being opened and closed, of the cushion case, wherein the two lateral side padding portions form the two lateral side walls of the cushion case, the bottom padding portion forms the bottom side wall of the cushion case, the lid padding portion forms the lid of the cushion case; wherein the panel padding forms a top panel wall and a base panel wall of the cushion case, wherein the top panel padding portion forms the top panel wall of the cushion case, and the base panel padding portion forms the base panel wall of the cushion case.

8. The cushion case for a mobile computer of claim 7, wherein the first lateral side coat, the second lateral side coat, the bottom padding coat, and the lid padding coat are made of fabrics or leathers.

9. The cushion case for a mobile computer of claim 7, wherein the top panel padding coat and the base panel padding coat are made of fabrics or leathers.

10. The cushion case for a mobile computer of claim 7 further comprising a ring and a ring-pull-belt, wherein the ring is attached to an opening end of the lid padding and the ring-pull-belt is attached to the ring for pulling the lid padding open.

* * * * *